US008388921B2

(12) United States Patent
Sayad-Yaghoubi

(10) Patent No.: US 8,388,921 B2
(45) Date of Patent: Mar. 5, 2013

(54) CARBOTHERMIC PROCESSES

(75) Inventor: Yaghoub Sayad-Yaghoubi, Mt Waverley (AU)

(73) Assignee: Thermical IP Pty Ltd., Mt. Waverley, Victoria (AU)

( * ) Notice: Subject to any disclaimer, the term of this patent is extended or adjusted under 35 U.S.C. 154(b) by 0 days.

(21) Appl. No.: 12/991,860

(22) PCT Filed: May 8, 2009

(86) PCT No.: PCT/AU2009/000577
§ 371 (c)(1),
(2), (4) Date: Jan. 24, 2011

(87) PCT Pub. No.: WO2009/135269
PCT Pub. Date: Nov. 12, 2009

(65) Prior Publication Data

US 2011/0165332 A1 Jul. 7, 2011

(30) Foreign Application Priority Data

May 9, 2008 (AU) ..... 2008902286

(51) Int. Cl.
*C01B 31/30* (2006.01)

(52) U.S. Cl. ..... 423/439; 75/674; 75/10.21

(58) Field of Classification Search ..... 423/439; 75/674
See application file for complete search history.

(56) References Cited

U.S. PATENT DOCUMENTS

| | | | | |
|---|---|---|---|---|
| 4,385,930 | A | 5/1983 | Persson | 75/10 R |
| 4,388,107 | A * | 6/1983 | Kibby | 75/10.27 |
| 6,475,260 | B2 * | 11/2002 | LaCamera | 75/10.27 |
| 6,530,970 | B2 * | 3/2003 | Lindstad | 75/10.27 |

FOREIGN PATENT DOCUMENTS

| | | | |
|---|---|---|---|
| WO | WO 2007/012123 | A1 | 2/2007 |
| WO | WO 2008/080188 | A1 | 7/2008 |

OTHER PUBLICATIONS

"The Price of Virtue" The Economist. Jun. 7, 2007. Online: http://www.economist.com/node/9302727?story_id=9302727 Accessed Mar. 28, 2012.*

Wikipedia, "*Aluminum Carbide*"; (retrieved on Jun. 25, 2009) from http://web.archive.org/web/20060913000000/http://en.wikipedia.org.wiki/Aluminum_carbide>published on Sep. 13, 2008 as per Wayback Engine.

International Search Report dated Jul. 6, 2009 from PCT/AU-2009/000577.

* cited by examiner

*Primary Examiner* — Daniel C McCracken
*Assistant Examiner* — Richard M Rump
(74) *Attorney, Agent, or Firm* — Ohlandt, Greeley, Ruggiero & Perle, LLP

(57) ABSTRACT

A mass of solid aluminum carbide containing product is produced by a process in which a mixture is formed of an aluminum containing material and a carbonaceous material consisting of, containing or yielding carbon. Then the resulting mixture is heated to a temperature sufficient to react carbon of the carbonaceous material with the aluminum of the aluminum containing material to produce solid aluminum carbide. The solid aluminum carbide then is able to be heated with an aluminum compound selected from $Al_2O_3$, $Al_4CO_4$, AlO, $Al_2O$ and mixtures thereof, to produce aluminum metal and carbon monoxide.

19 Claims, 2 Drawing Sheets

CARBOTHERMIC PROCESSES

CLAIM OF PRIORITY

This application claims priority to PCT/AU09/00577 filed May 8, 2009 which itself claims priority to Australian Application No. 2008902286 which are both hereby incorporated by reference in their entirety.

FIELD OF THE INVENTION

This invention relates to carbothermic processes involving alumina.

BACKGROUND OF THE INVENTION

For aluminium production, technology based on a carbothermic process is promising and offers the prospect of an alternative to the Hall-Héroult electrolytic technology. A successful carbothermic process would have the potential to reduce capital investment requirements by 50 to 70% and operating costs by 25 to 35% compared to the current electrolytic route. Also, the problem of fluoride emission would be obviated, while the quantity of generated carbon containing gases would be substantially lower than for electrolytic production of aluminium.

Attempts to produce aluminium by a carbothermic process have been made for in excess of 100 years. However, optimisation of a carbothermic process to enable successful commercial production of aluminium is yet to be achieved. Processes investigated to this stage (other than the applicant's) require temperatures in excess of 2,000° C. and accurate control of reactants and products at different complex stages. The stages include:

(a) reaction of alumina and carbon to produce aluminium carbide at above 2,000° C.;

(b) reaction of the aluminium carbide with alumina to produce aluminium metal at above 2,150° C.; and (c) separation of the aluminium from remaining materials.

Challenges to be met in such carbothermic process include successfully recovering the high level of volatilized aluminium, reducing the level of refractory loss, the difficulties of transferring materials between stages and the problem of generation of a high volume of carbon monoxide. Such issues are inevitable at operating temperatures as high as 2,000 to 2,250° C.

Reactions central to the carbothermic processes are:

$$2Al_2O_3+9C \rightarrow Al_4C_3+6CO, \quad (1) \text{ and}$$

$$Al_2O_3+Al_4C_3 \rightarrow 6Al+3CO \quad (2)$$

These reactions give the overall reaction of:

$$Al_2O_3+3C \rightarrow 2Al+3CO \quad (3)$$

Earlier work on the production of aluminium by these reactions is illustrated by U.S. Pat. Nos. 1,219,797 and 1,222,593 both to Barnet et al; U.S. Pat. Nos. 2,090,451 and 2,255,549 both to Kruh; U.S. Pat. No. 2,755,178 to Rasmussen; U.S. Pat. No. 2,776,884 to Grunert alone; and U.S. Pat. No. 2,829,961 to Miller at al; and U.S. Pat. No. 2,974,032 to Grunert.

More recent work has been directed to reacting alumina and carbon in a molten bath having a molten slag of aluminium carbide and alumina. The molten bath usually operates with two zones, in a first of which aluminium carbide is generated, and a second to which the carbide passes to be reacted with alumina to produce metallic aluminium. This work is illustrated by U.S. Pat. No. 4,385,930 to Persson; U.S. Pat. No. 6,440,193 to Johansen et al; U.S. Pat. No. 6,475,260 to LaCarmera; U.S. Pat. No. 6,530,970 to Lindstad; U.S. Pat. No. 6,849,101 to Fruehan et al; and U.S. patent application publication 2006/0042413.

Also of interest are the publications: "Carbothermal Production of Aluminium" by Motzfeldt et al, published in 1989 by Aluminium-Verlag GmbH of Dusseldorf, Germany; and "Aluminium Carbothermic Technology" submitted to U.S. Department of Energy under Cooperative Agreement Number DE-FC36-00ID13900 by MJ Bruno and Alcoa Inc, and dated 31 Dec. 2004.

SUMMARY OF THE INVENTION

The applicant has developed their own carbothermic process in which aluminium carbide is generated through the reaction of an initial amount of aluminium metal with a carbonaceous material, in the presence of alumina. This mixture forms a charge that can be heated to a temperature at which the alumina and aluminium carbide readily react to produce aluminium metal. The process in which alumina and carbon is injected into molten aluminium is taught in the applicant's international patent publication No. WO2007012123. A further version, utilising the injection of hydrocarbon material and alumina into an aluminium melt, is taught in the applicant's international patent application No. PCT/AU2007/001986. It should be understood that the disclosure of each of the applicant's previous applications are incorporated herein by reference to be read as part of the present disclosure.

The present invention is directed to providing an alternative to the approaches adopted in the third party prior art considered in the "Background of the Invention" set out earlier herein. The present invention also provides alternatives and/or improvements to the applicant's inventions disclosed in international patent publication No. WO2007012123 and international patent application No. PCT/AU2007/001986.

In accordance with a first aspect, the present invention provides a process for producing a mass of solid aluminium carbide containing product, wherein the process includes the steps of:

(a) forming a mixture of an aluminium containing material and a carbonaceous material, consisting of, containing or yielding carbon, (b) heating the mixture formed in step (a) to a temperature sufficient to react carbon of the carbonaceous material with the aluminium of the aluminium containing material to produce solid aluminium carbide.

In the process of the present invention, carbon of the carbonaceous material reacts with the aluminium of the aluminium containing material to produce aluminium carbide following the reaction:

$$4Al+3C \rightarrow Al_4C_3 \quad (4)$$

This reaction is noticeable at about 1,100° C. However, it proceeds with higher kinetics above 1,400° C. The reaction is exothermic and, in contrast to the carbide forming reaction of equation (1) above, it does not produce any carbon monoxide gas. This is a very significant advantage for the present invention, as the reaction of equation (1) produces two-thirds of the substantial volume of carbon monoxide produced in the prior art carbothermic processes.

In one form of the process of the first aspect, the mixture formed in step (a) also includes aluminium oxide, such as alumina. In that form, the aluminium carbide resulting from step (b) is ultimately mixed with the aluminium oxide, to produce a mass suitable for use in the production of aluminium by the process according to a second aspect of the invention detailed herein. However, such a mass can be produced by adding the aluminium oxide to the aluminium carbide produced in step (b).

In accordance with a second aspect, the present invention also provides a process for the recovery of aluminium metal. In this, an aluminium carbide containing product is produced in accordance with the first aspect of the present invention, and the aluminium carbide containing product is heated to react the aluminium carbide and an aluminium compound selected from $Al_2O_3$, $Al_4CO_4$, AlO, $Al_2O$ and mixtures thereof to produce aluminium metal and carbon monoxide. The aluminium carbide may be produced in a first reactor, and reacted with the aluminium oxide in a second reactor. The second reactor, in which the aluminium carbide containing product is heated, may be spaced from the first reactor in which that product is formed. That is, the aluminium carbide containing product may be transferred to a separate, second reaction vessel in which it is heated.

The production of aluminium in accordance with the invention provides a net gain in aluminium over the aluminium reacted in step (b). The net gain, of course, is from the aluminium that is added as oxide. However, the aluminium reacted to produce carbide is recovered by the process, and this enables two important alternatives to the process. The first of these alternatives is that the aluminium reacted to produce carbide can be, and preferably is in that alternative, recycled waste material. One form of waste material is recycled aluminium metal from a wide variety of possible sources. Another form of recycled waste material comprises aluminium dross which, in addition to providing aluminium metal, also contributes aluminium oxide from which aluminium can be recovered in the metal recovery phase. In that alternative of using recycled waste, the aluminium reacted in step (b) of the process typically will be solid scrap broken down into suitable particle sizes.

A second alternative is that of recycling part of the aluminium produced by the process. Thus, the aluminium mixed with carbonaceous material in step (a) can be recycled. In that alternative, it usually will be convenient to recycle the aluminium as a liquid, and to spray the metal over the carbonaceous material, or over a mixture of the carbonaceous material and aluminium oxide, such as alumina.

The ability to rely on reaction (4) in the present invention is contrary to knowledge in the art. That reaction has been thought to be lacking in utility, as $Al_4C_3$ has been believed to be unstable above about 1,450° C. However, we have found that this is not the case. We have found that the $Al_4C_3$ can be successfully produced, preferably at a temperature in excess of about 1,400° C., such as up to about 1,650° C., more preferably from about 1,450° C. to 1,600° C.

Reaction (4) can be conducted in a suitable reactor charged only with aluminium and carbon. On completion of the reaction, alumina or another suitable source of aluminium oxide can be added to the resultant $Al_4C_3$ in a suitable reactor and heated to produce aluminium metal. Reaction (4) need not proceed to completion prior to adding the oxide, as the reaction can continue after the addition of the oxide. Indeed, in an alternative form of the invention, a mixture of carbon, aluminium and alumina or other source of aluminium oxide can be prepared, and that mixture then heated as indicated above to generate $Al_4C_3$ by reaction (4). In each case, the requirement is for a resultant mixture of $Al_4C_3$ and aluminium oxide, and the production of $Al_4C_3$ in the presence of the oxide can produce a more intimate mixture.

It is preferred that reaction (4) is conducted with a stoichiometric excess of aluminium metal. That is, it is preferred that the reaction proceeds as:

$$4Al+3C+xAl \rightarrow Al_4C_3+xAl \quad (5)$$

or as:

$$Al_2O_3+4Al+3C+xAl \rightarrow Al_2O_3+Al_4C_3+xAl \quad (6)$$

depending on whether the carbide is produced in the presence of aluminium oxide.

In each of reactions (5) and (6), x is a value which can be controlled regarding the technique of production of $Al_4C_3$ and the requirements for proceeding to the stage for the production of aluminium metal. It has been found that at the production temperatures, the following reaction occurs:

$$4Al_2O_3+Al_4O_3 \rightarrow 3Al_4CO_4 \quad (7)$$

Thus, the produced charge will contain $Al_4CO_4$. Therefore, during the second stage of the process for metal production, the following overall reactions occur during the heating of the mixture or charge of $Al_4C_3$ and alumina (or other aluminium oxide source):

$$Al_2O_3(s)+Al_4C_3(s) \rightarrow 6Al(l)+3CO(g) \quad (2)$$

$$Al_4CO_4(s)+Al_4C_3(s) \rightarrow 8Al(l)+4CO(g) \quad (8)$$

However, based on the findings in this invention, these reactions start at above 1,300° C. Thermodynamically, the occurrence of the reactions (2) and (8) and the reactions kinetics obtained in this invention are consistent with production Of $Al_2O$ and AlO as follows:

$$Al_2O_3(s)+4Al \rightarrow 3Al_2O(g) \quad (9)$$

$$Al_4CO_4(s)+2Al(l) \rightarrow 3Al_2O(g)+CO(g) \quad (10)$$

$$Al_2O_3(s)+Al(l) \rightarrow 3AlO(g) \quad (11)$$

$$Al_4CO_4(s) \rightarrow CO(g)+3AlO(g)+Al \quad (12)$$

and then reaction of $Al_2O$ and AlO with Al4C3 as follows:

$$3Al_2O(g)+Al_4C_3(s) \rightarrow 10Al(l)+3CO(g) \quad (13)$$

$$3AlO(g)+Al_4C_3(s) \rightarrow 7Al(l)+3CO(g) \quad (14)$$

Accordingly, for metal production, solid reactants $Al_2O_3$, $Al_4CO_4$ and $Al_4C_3$ react through a gaseous route.

The reaction of equation (4) occurs as the mixture of carbonaceous material, particulate alumina and aluminium containing material are heated to a suitable temperature. As a consequence, the solid aluminium carbide produced by the reaction of equation (4) is able to intermix and/or attach to alumina particles, to produce the mass of aluminium carbide containing product.

Unlike the processes taught in the applicant's previous patent applications, alumina and carbon are not injected into a molten bath of aluminium. On the contrary, a mixture, preferably an intimate mixture of alumina, a carbonaceous material and a solid aluminium containing material are heated together to a reaction temperature of reaction (4) having acceptable kinetics. An intimate mixture of alumina, carbonaceous material and aluminium containing material allow reaction (4) to proceed throughout the heating process of step (b) in excess of about 1,100° C.

Various different forms of aluminium containing material can be used in the process of the present invention:

In one form of the invention, the solid aluminium containing material substantially comprises aluminium metal, such as recycled aluminium scrap. The aluminium metal can be in distinct particles, shredded pieces, pellets, turnings, swarf or the like. The solid aluminium containing material includes granular aluminium and/or particulate aluminium. Again, it is preferable for the nodular aluminium and/or particulate aluminium to be of a size that facilitates mixing of the aluminium containing material with the alumina and carbonaceous material.

In another form of the invention, the solid aluminium containing material includes an aluminium scrap metal content, and more preferably substantially comprises aluminium scrap metal. In this form, the process of the present invention can be used to recycle scrap aluminium metal such as from aluminium cans, aluminium bottles, scrap structural aluminium, scrap extrusions and castings, or similar. Again, it is preferable for the scrap aluminium metal to be in a comminuted form, for example shredded, crushed, powdered, ripped or similar to form particles having a size suitable to be mixed with alumina and the carbonaceous material. Following the process of the present invention, a net increase in aluminium is produced. The process according to the present invention can produce at least 1.5 times the amount of recycled aluminium initially fed into the process as the aluminium containing material in step (a).

In yet a further form of the invention, the solid aluminium containing material includes aluminium dross. Aluminium dross is an oxidised waste product produced when aluminium is molten. Aluminium dross can have a varying composition depending on the process involved in its production and the impurities present in the melt. Generally, material referred to as aluminium dross predominantly contains aluminium oxide and aluminium metal. In this form, the process of the first aspect of the present invention can be used to reclaim the aluminium metal and aluminium oxide present in the dross. The aluminium dross is provided in a particulate form to facilitate mixing of the aluminium containing material with the alumina and carbonaceous material.

In each of the above discussed forms, it is preferable for the aluminium containing material to be in small pieces or particles to facilitate mixing of the aluminium containing material with the alumina and carbonaceous material. A mixture of alumina, carbonaceous material and aluminium containing material can be formed when each of the particles in the mixture fall within a generally similar size range. For example, the alumina may have a maximum particle size of about 5 mm. Also, the carbonaceous material may have a maximum particle size of about 5 mm. The solid aluminium containing material therefore preferably may have a maximum thickness of 10 mm, such as a thickness of about 2 mm.

In other forms, the aluminium containing material can be formed from an aluminium melt to provide an aluminium material content in a suitable form. For example, in one form the aluminium containing material is produced by spraying molten aluminium onto alumina, carbonaceous material or a mixture of alumina and carbonaceous material. The molten aluminium can be sprayed onto the alumina and/or carbonaceous material in various arrangements. In one form, the molten aluminium is sprayed onto the alumina and/or carbonaceous material in a fixed arrangement, such as with the alumina and/or carbonaceous material held in a tray, spread out on a surface or held in a vessel. In another form, the molten aluminium is sprayed onto the alumina and/or carbonaceous material in a fluidised bed reactor.

The mixture of alumina, carbonaceous material and aluminium containing material of step (a) of the process of the first aspect of the present invention can be formed through mixing each of the individual components together in one step or alternatively in several steps. In one form, step (a) includes the steps of:

(i) forming a mixture of alumina and a carbonaceous material; and (ii) mixing a solid aluminium containing material with the mixture of alumina and carbonaceous material.

The carbonaceous material used in the mixture of step (a) of the process can be any carbon containing material which can be used to provide a liquid and/or solid carbon containing material to be mixed with the alumina and aluminium containing material ready for heating. The carbonaceous material can therefore be a solid carbon or carbon containing material, graphite, coal, charcoal or the like, a solid carbon containing combustion product, a hydrocarbon material, or a hydrocarbon material produced by pyrolysis, decomposition or cracking of a hydrocarbon material.

The carbonaceous material used in the mixture of step (a) of the process may at least partially include a liquid or solid carbon containing material produced by pyrolysis, decomposition or cracking of a hydrocarbon material. The hydrocarbon can comprise any suitable species. In a preferred form, the hydrocarbon comprises at least one of methane, ethane, butane, pentane, higher alkanes, natural hydrocarbon gases, petroleum bases, petroleum liquids, alkenes and tar pitch. The carbon of the carbonaceous material may at least partially be provided by a gas comprising a hydrocarbon material. The hydrocarbon may also be mixed with argon, hydrogen or a mixture of argon and hydrogen. Hydrocarbon gas, hydrogen and/or argon may be used as the fluidising gas for the fluidised bed reactor.

The mixture of alumina, carbonaceous material, and aluminium containing material is preferably heated to in excess of 1,400° C. To achieve a sufficient rate of reaction, the temperature preferably is in excess of about 1,400° C., such as from about 1,400° C. to 1,650° C., more preferably between 1,450° C. to 1,600° C. Higher temperatures in excess of about 1,650° C. can be used, although such higher temperatures preferably are avoided as they add unnecessarily to operating costs.

The aluminium carbide containing product may be heated in any suitable way. The product may be heated electrically. Induction heating is possible, as the aluminium carbide containing product is conductive and enables inductive heating of the product. Also, plasma heating can be used. However, electric arc heating is a preferred and most practical form of heating.

In a preferred arrangement, the second reactor in which the aluminium carbide containing product is heated is in the form of an electric arc furnace (EAF) which has a plurality of electrodes to provide electrical energy for heating the product. The electrodes are arranged such that each generates an arc at the upper part of the aluminium carbide containing product to provide a region of intense local heating at which the aluminium carbide and alumina of the product are caused to react.

The intense local heating at an arc generated by each electrode may result in a very high temperature. However, the temperature of the aluminium carbide containing product sharply decreases with the distance away from the arcs. The arrangement can be such that the intense localised heating is submerged, such that, around the periphery of the EAF, the temperature of the aluminium carbide containing product is as low as about 1,000 to 1,300° C. With this arrangement the main body of the product around the electrodes will be at a temperature of from about 1,700° C. to 1,850° C. Heating within this range is found to be sufficient to enable the reaction of equations (2) and (8) to proceed at an acceptable rate for the recovery of aluminium metal, at least under preferred conditions permitted by the present invention, although higher temperatures such as up to 2,000° C. can be used.

In a form of the invention which can enhance the rate of the reaction of equations (2) and (8) at a temperature as low as about 1,650° C. carbon monoxide is removed from the upper surface of the aluminium carbide containing product and from the region of intense local heating generated by the arcs. This can be achieved by:

(a) maintaining a sufficiently low gas pressure in the second zone, above the aluminium carbide containing product to extract carbon monoxide; and (b) flushing upper surface of the aluminium carbide containing product, including the region of intense local heating generated by the arcs, with hydrogen or, if argon is used, a combination of argon and hydrogen.

Most preferably the carbon monoxide is removed by a combination of operating with a reduced pressure above the aluminium carbide containing product and flushing the upper surface of that product with hydrogen or a combination of argon and hydrogen.

The removal of carbon monoxide favours the forward reaction of equations (2) and (8). The extent to which this occurs is such that the reaction proceeds at an acceptable rate at temperatures of from about 1,650° C. to 2,000° C., preferably from 1,700° C. to 1,850° C. Thus, contrary to prior art proposals, it is not necessary to operate at a temperature above 2,150° C. to enable the reaction of equation (2) to proceed.

The first and second reactors preferably are in a sealed installation sufficient to prevent the ingress of atmospheric air. A gas space of the second zone, above the aluminium carbide containing product, may communicate with a vacuum generating system operable to reduce the pressure in the gas space to a suitable level. A sufficiently reduced pressure enables the forward reaction of equations (2) and (8) to proceed at a sufficient rate at about 1,700° C.

BRIEF DESCRIPTION OF THE DRAWINGS

In order that the invention may more readily be understood, reference is made to the accompanying drawings which illustrate a particular preferred embodiment of the present invention, wherein.

DESCRIPTION

The starting point for the present invention was the applicant's experimental work to determine the viability of using aluminium turnings and aluminium pellets as an aluminium source for the reaction of equation (4) to produce solid aluminium carbide. The experiments were carried out in graphite crucibles.

In the experiments, an alumina and carbon mixture (in the form of charcoal particles) and aluminium turnings (swarf) were thoroughly mixed together and placed in a graphite crucible. The graphite crucible was then sealed using a purpose built graphite lid. The lid included a central hole through which an alumina tube can be located.

An alumina tube to be used as a lance for injecting argon into a crucible was lowered endwise through the hole in the alumina cap of the graphite crucible. The crucible then was placed in an induction furnace for heating. The induction furnace includes a graphite susceptor defining a space in which the graphite crucible can be located. An R-type thermocouple was located in a space between the graphite crucible and the graphite susceptor.

The crucible was then heated from room temperature to 1,550° C. over a 100 minute period and held at 1,550° C. for 20 to 30 minutes. An argon flow (500 mL/min) was fed to the graphite crucible for the duration of each experiment. Once the heating regime is completed, the crucible is allowed to cool. When cool, the crucible was removed and opened to enable examination of its contents.

Figure 1:
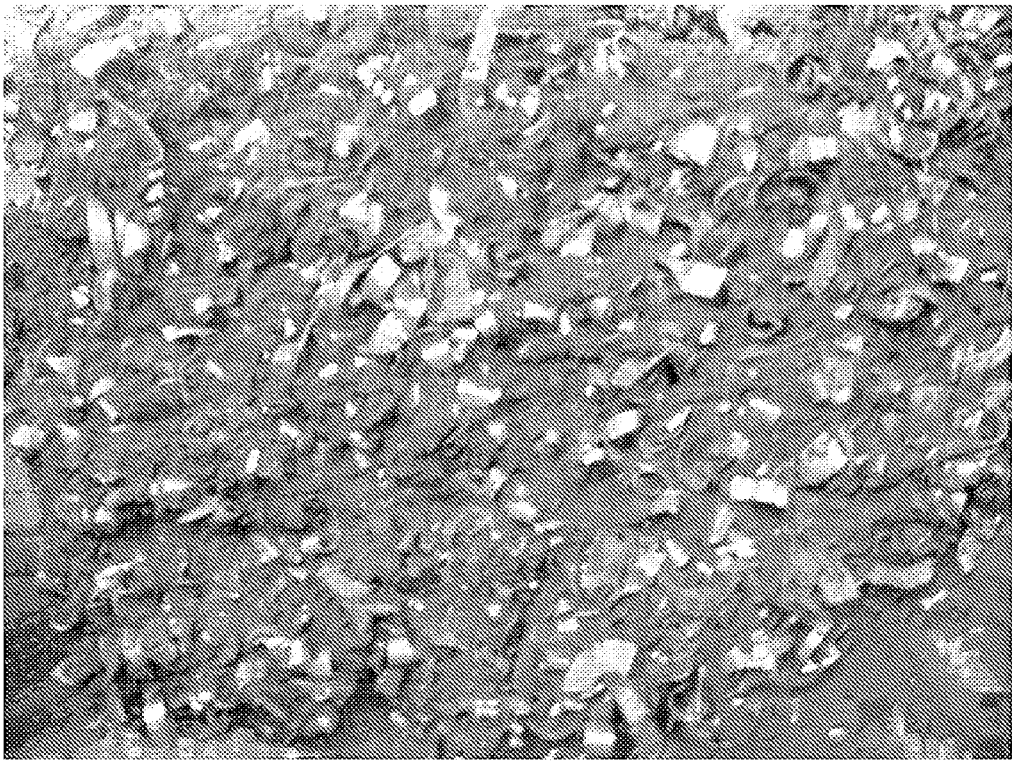
FIG. 1 shows a micrograph of an alumina, carbon and aluminium swarf particle feed mixture for a first embodiment of the process according to the present invention.

Two different experimental runs were conducted:

In run of the first embodiment, 250 g of 100% aluminium swarf having a maximum particle size of 5 mm was mixed with a mixture of 148 g of alumina and 52 g of carbon. The alumina and carbon mixture had an average particle size of less than 100 μm. The feed for the run is shown in FIG. 1. The charge produced from heating the feed mixture for that run is shown in FIG. 2.

Figure 3:
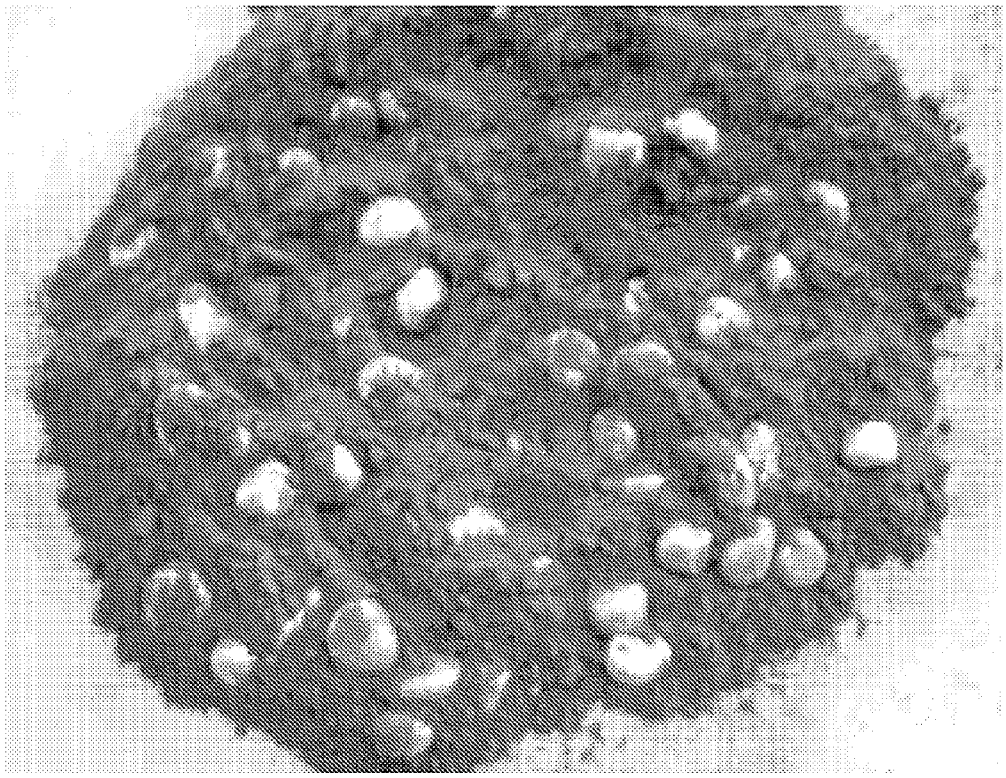
FIG. 3 shows a micrograph of an alumina, carbon and aluminium pellet particle feed mixture for a second embodiment of the process according to the present invention.

In run of the second embodiment, 280 g of 30% aluminium swarf and 70% aluminium pellets having a particle size of between 6 to 10 mm was mixed with a mixture of 179 g of alumina and 63 g of carbon. The alumina and carbon mixture was coarser than the alumina and carbon mixture used in run of the first embodiment. The feed for run of the second embodiment is shown in FIG. 3, while the charge produced from heating the feed mixture of that run is shown in FIG. 4.

During the each of the runs, it was observed that carbon and alumina become adhered to the surface of the aluminium particles by at most 1,200° C., forming a surface layer on the aluminium particles. The reaction of equation (4) proceeds at and above this temperature, progressively converting the carbon and aluminium to carbide.

Figure 2:
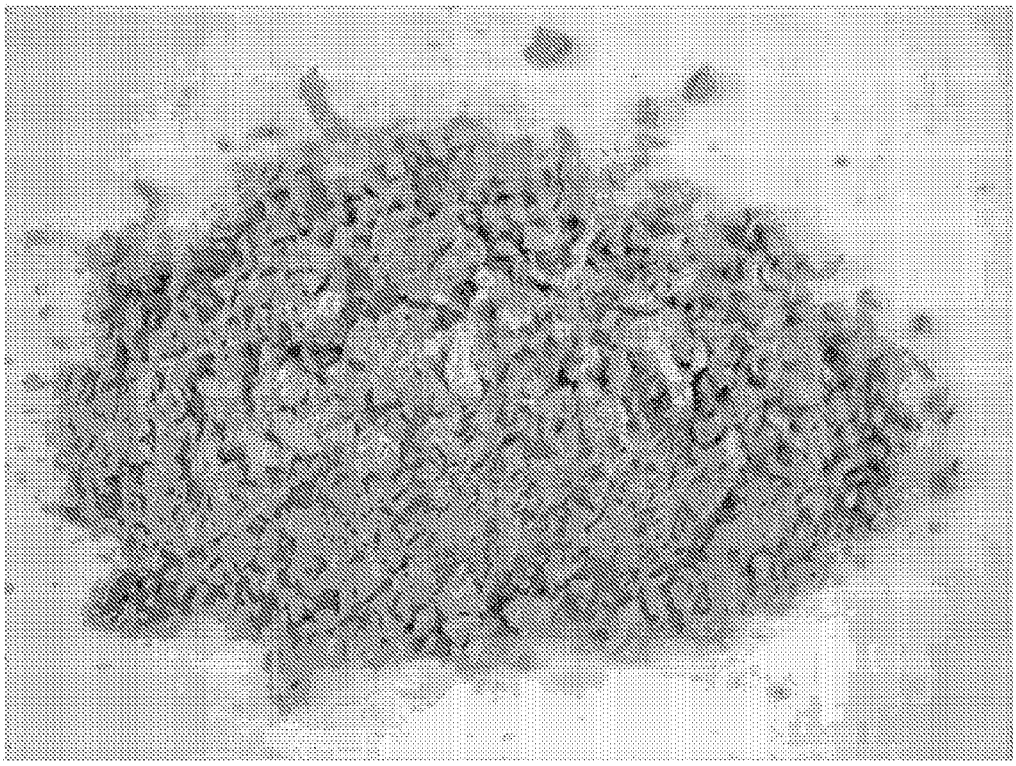
FIG. 2 shows a photograph of the charge produced from heating the feed mixture shown in FIG. 1.
Figure 4:
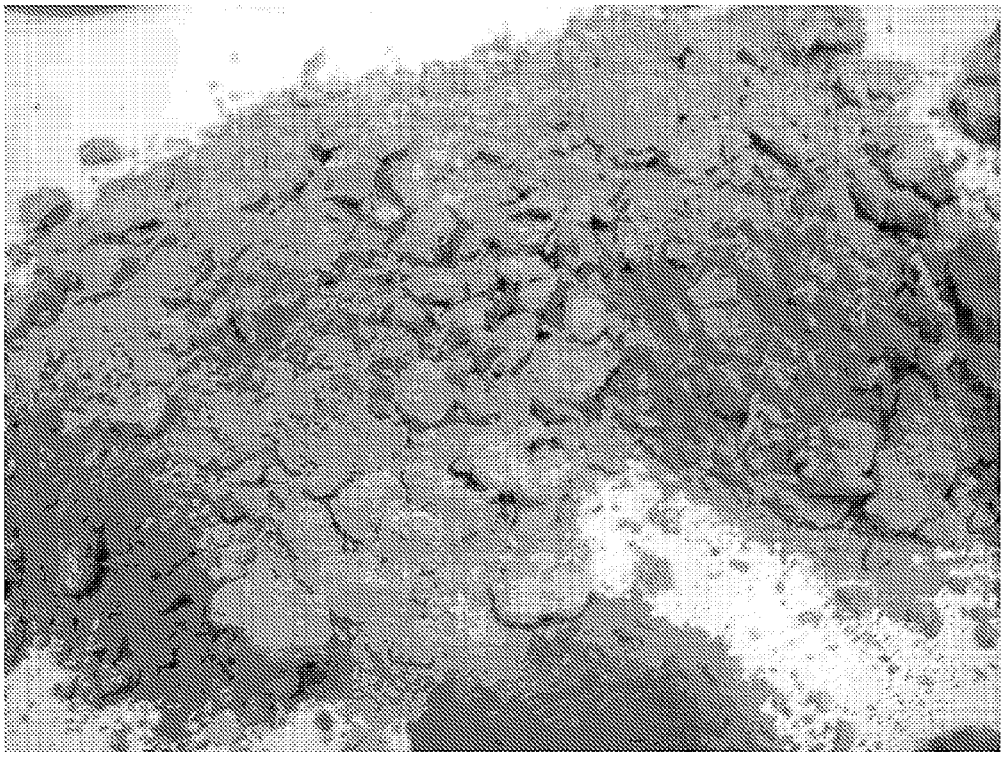
FIG. 4 shows a photograph of the charge produced from heating the feed mixture shown in FIG. 3.

As shown in FIGS. 2 and 4, the resulting charge comprises a well distributed particulate mixture of aluminium carbide and alumina containing minor proportions of aluminium. The contents of the crucible of each run could be easily removed without significant damage to the crucible, allowing reuse of the crucible.

While not wishing to be limited by any one theory, it is thought that the thorough mixing of the aluminium particles, alumina and carbon facilitates a generally even distribution of reactants for reaction (4) through out the mixture which can then subsequently react when the temperature of the mixture is raised.

Comparing the two runs, it is observed that the extent of the conversion of aluminium to aluminium carbide appears to be related to the carbon and aluminium grain size. In this respect, the small particle sizes are though to provide better mixing and contact between the various components of the mixture.

The generated aluminium carbide product was found to be very fine, and well suited to mixing with particulate alumina. Thus, the aluminium carbide is well suited for production under conditions for the process of the first aspect of the present invention to produce a mass of solid aluminium carbide containing mass in which the carbide is mixed with alumina. Similarly, the aluminium carbide is well suited for use in the production of aluminium metal according to the second aspect of the present invention.

A minor mass loss of 2 to 3% of total mass was recorded for each run of each embodiment. This mass loss is thought to be largely the result of moisture loss from the crucible and materials as none of these components were preheated prior to the experimental runs.

The applicant's international patent application No. PCT/AU2007/001986 used hydrocarbons as a source of carbon for reaction (4). As hydrocarbons such as methane decompose and thermally crack, finely dispersed carbon is produced, while hydrogen gas is liberated. The finely dispersed carbon has a small particle size, such as from about 20 μm to about 500 μm, and a high surface area, such as from about 1 to 10 $m^2/g$. The carbon is very reactive and, when the decomposition and thermal cracking results from the injection of hydrocarbon into molten aluminium, aluminium carbide is produced by reaction (4). The overall effect of the hydrocarbon injection is as represented by reactions (5) and (6). It is thought that this process would be suitable for producing carbonaceous material for use in the process according to the first aspect of the present invention.

Technologically, it is possible to use a carbonaceous material comprising hydrocarbon material, such as methane, as the sole source of carbon in the process of the present invention. For this option, the methane rate for example for a 50,000 ton/year aluminium production installation would be about 9500 $Nm^2$/hour and an off-gas rate of 28,500 $Nm^2$/hour. These gas rates can be managed in a reactor as large as, for example, a steel converter with a 100 to 110 tonnes capacity; that is, a small converter in steel production technology.

Finally, it is to be understood that various alterations, modifications and/or additions may be introduced into the constructions and arrangements of parts previously described without departing from the spirit or ambit of the invention.

The invention claimed is:

1. A process for producing a mass of solid aluminum carbide containing product, wherein the process comprises the steps of:

(a) forming a mixture of an aluminum containing material, which is recycled and which is or includes aluminum scrap metal, aluminum dross or aluminum metal recycled from aluminum produced from the solid aluminum carbide containing product, and a carbonaceous material providing a source of carbon, and (b) heating the mixture formed in step (a), to a temperature in the range of 1450° C. to 1650° C., to react the carbon of the carbonaceous material with the aluminum of the aluminum containing material to produce solid aluminum carbide.

2. A process according to claim 1, wherein the mixture formed in step (a) further comprises alumina.

3. A process according to claim 1, wherein alumina is mixed with the aluminum carbide produced in step (b).

4. A process according to claim 1, wherein the aluminum containing material is recycled aluminum scrap metal.

5. A process according to claim 1, wherein the aluminum containing material is particles of aluminum dross.

6. A process according to claim 1, wherein step (a) further comprises spraying molten aluminum metal onto alumina, carbonaceous material, or a mixture of alumina and carbonaceous material to form said mixture.

7. A process according to claim 6, wherein the molten aluminum is sprayed onto the alumina, carbonaceous material or a mixture thereof in a fixed or fluidised bed.

8. A process according to claim 1, wherein step (a) includes the steps of:

(i) forming a mixture of alumina and a carbonaceous material; and (ii) mixing a solid aluminum containing material with the mixture of alumina and carbonaceous material.

9. A process according to claim 1, wherein the aluminum containing material has a maximum particle size of 5 mm.

10. A process according to claim 2, wherein the aluminum oxide has a maximum particle size of 5 mm.

11. A process according to claim 1, wherein the carbonaceous material has a maximum particle size of 5 mm.

12. A process according to claim 1, wherein the carbonaceous material is a liquid or solid hydrocarbon material or is a liquid or solid carbon containing material produced by pyrolysis, decomposition or cracking of a hydrocarbon material.

13. A process according to claim 1, wherein the carbon of the carbonaceous material is at least partially provided by a gas comprising a hydrocarbon material which is decomposed or cracked to yield carbon and hydrogen on or before being mixed with the alumina and aluminum containing material.

14. A process according to claim 12, wherein the hydrocarbon comprises at least one of methane, ethane, butane, pentane, higher alkanes, natural hydrocarbon gases, petroleum bases, petroleum liquids, alkenes and tar pitch.

15. A process for the recovery of aluminum metal comprising producing a mass of solid aluminum carbide containing product, wherein the process includes the steps of:

(a) forming a mixture of an aluminum containing material, which is recycled and which is or includes aluminum scrap metal, aluminum dross or aluminum metal recycled from aluminum produced from the solid aluminum carbide containing product, and a carbonaceous material providing a source of carbon, and (b) heating the mixture formed in step (a) to a temperature in the range of 1450° C. to 1650° C. to react the carbon of the carbonaceous material with the aluminum of the aluminum containing material to produce solid aluminum carbide;

wherein said solid aluminum carbide is heated to react the solid aluminum carbide with an aluminum compound selected from the group consisting of $Al_2O_3$, $Al_4CO_4$, AlO, $Al_2O$ and mixtures thereof to produce aluminum metal and carbon monoxide.

16. A process according to claim 15, wherein the aluminum carbide containing product is produced in a first reactor spaced from a reactor in which that product is reacted with aluminum oxide.

17. A process according to claim 16, wherein the heating in the second reactor is by induction heating, electric arc heating or plasma heating.

18. A process according to claim 15, wherein a main body of the aluminum carbide containing product is heated to a temperature of from 1,700° C. to 2,000° C.

19. A process according to claim 15, wherein carbon monoxide is rapidly removed as it is produced.

* * * * *